US006224409B1

(12) United States Patent
Chang

(10) Patent No.: US 6,224,409 B1
(45) Date of Patent: May 1, 2001

(54) AUDIO JACK

(75) Inventor: Jen Jou Chang, Youg-Ho (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/665,316

(22) Filed: Sep. 19, 2000

(30) Foreign Application Priority Data

May 23, 2000 (TW) ..... 0089208742

(51) Int. Cl.[7] ..... H01R 29/00
(52) U.S. Cl. ..... 439/188; 439/668
(58) Field of Search ..... 439/188, 668, 439/669, 217, 223, 108

(56) References Cited

U.S. PATENT DOCUMENTS

| | | | | |
|---|---|---|---|---|
| 4,364,625 | * | 12/1982 | Baker et al. | 439/188 |
| 4,367,907 | * | 1/1983 | Buck | 439/188 |
| 5,022,872 | * | 6/1991 | Shichida | 439/668 |
| 5,919,052 | * | 7/1999 | Ho | 439/668 X |
| 6,050,854 | * | 4/2000 | Fang et al. | 439/668 X |
| 6,056,602 | * | 5/2000 | Wu | 439/668 |

* cited by examiner

*Primary Examiner*—Khiem Nguyen
*Assistant Examiner*—Son V. Nguyen
(74) *Attorney, Agent, or Firm*—Wei Te Chung

(57) ABSTRACT

An audio jack comprises an insulative housing (1) defining a plug insertion hole (104) for receiving a contact of a plug connector, and a plurality of fixing terminals (2) and resilient terminals (3) received in corresponding receiving grooves (120, 140) in both sides of the housing. Each resilient terminal comprises a main body (30), a connecting portion (34) perpendicularly extending from the main body, a resilient arm (35) slantwise extending from the connecting portion round and away from the main body, and a contact portion (36) at a free end of the resilient arm extending toward the main body for connecting with the fixing terminal. Before the plug connector is inserted into the plug insertion hole of the audio jack, the contact portion of the resilient terminal abuts against the fixing terminal. When the plug connector is inserted into the plug insertion hole of the audio jack, the contact of the plug connector pushes the contact portion of the resilient terminal away from the fixing terminal thereby establishing signal transmission between the plug connector and the audio jack. The resilient arm of the resilient terminal has enough length to provide the resiliency needed to restore the contact portion to its original position.

1 Claim, 6 Drawing Sheets

AUDIO JACK

BACKGROUND OF THE INVENTION

1. Field of the Invention

The present invention relates to an audio jack, and particularly to an audio jack used in a PDA (Personal Digital Assistant) to connect with a complementary plug connector for transmitting signals.

2. The Related Art

With the rapid development of electrical devices such as PDAS, mobile phones and notebooks, audio jacks mounted on printed circuit boards in these electrical devices are increasingly used for transmitting signals to complementary plug connectors. Referring to FIG. 7, U.S. Pat. No. 5,022,872 discloses a conventional audio jack comprising an insulative housing 5, a first terminal 6 received in a first groove 102 of the housing 5, a second terminal 7 received in a second groove 104 of the housing 5 and a third terminal 8 received in a third groove 106 of the housing 5. The first terminal 6 has a frame portion 64, a contact arm 65 extending upwardly from one side (not labeled) of the frame portion 64 for connecting with a contact of a plug connector (not shown), and a mounting tail 66 extending downwardly from the same side of the frame portion 64 for mounting to a printed circuit board (not shown). The second terminal 7 has the same construction as the first terminal 6. The third terminal 8 has a main body 82, a pair of opposite mounting legs 87 at both ends of the main body 82 for mounting to the printed circuit board and a pair of resilient curved contact tongues 88 extending from the main body 82 in a forward direction from between the mounting legs 87. A clamping space 89 is defined between the resilient contact tongues 88 for receiving and clamping the contact of the plug connector. However, because the resilient contact tongues 88 of the third terminal 8 are too short to allow a large amount of deformation, they are not capable of providing enough clamping force to clamp the contact of the plug connector when the plug connector mates with the jack. In addition, in actual use, after repeated insertions of the contact of the plug connector into the audio jack, the resilient contact tongues 88 may be plastically deformed, losing their original shape and adversely affecting proper connection with the plug connector. Hence, an improved electrical connector is required to overcome the disadvantages of the prior art.

BRIEF SUMMARY OF THE INVENTION

A main object of the present invention is to provide an audio jack which comprises a resilient terminal having a resilient arm with sufficient flexibility to prevent plastic deformation thereof.

An audio jack of the present invention comprises an insulative housing defining a plug insertion hole for receiving a contact of a plug connector and a plurality of fixing terminals and resilient terminals received in corresponding receiving grooves in both sides of the housing. Each resilient terminal comprises a main body, a connecting portion perpendicularly extending from the main body, a resilient arm slantwise extending from the connecting portion round and away from the main body, and a contact portion at a free end of the resilient arm extending toward the main body for connecting with the fixing terminal. Before the plug connector is inserted into the plug insertion hole of the audio jack, the contact portion of the resilient terminal abuts against the fixing terminal. When the plug connector is inserted into the plug insertion hole of the audio jack, the contact of the plug connector pushes the contact portion of the resilient terminal away from the fixing terminal thereby establishing signal transmission. The resilient arm of the resilient terminal has sufficient length to provide it with enough resiliency to ensure that the contact portion is restore to its original position when the plug connector is removed.

Other objects, advantages and novel features of the invention will become more apparent from the following detailed description of the present embodiment when taken in conjunction with the accompanying drawings.

DETAILED DESCRIPTION OF THE INVENTION

Figure 1:
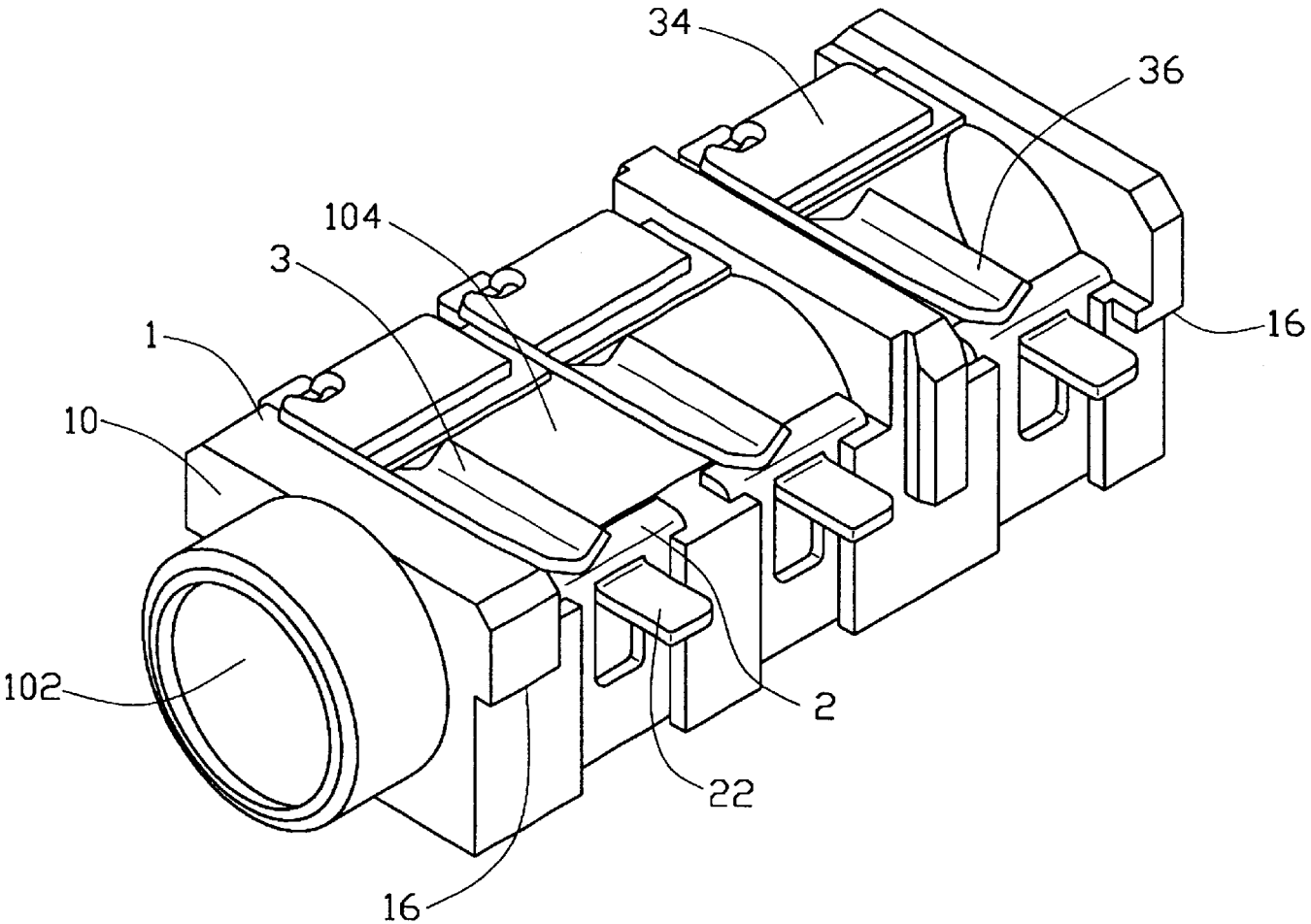
FIG. 1 is a perspective view of an audio jack in accordance with the present invention.
Figure 2:
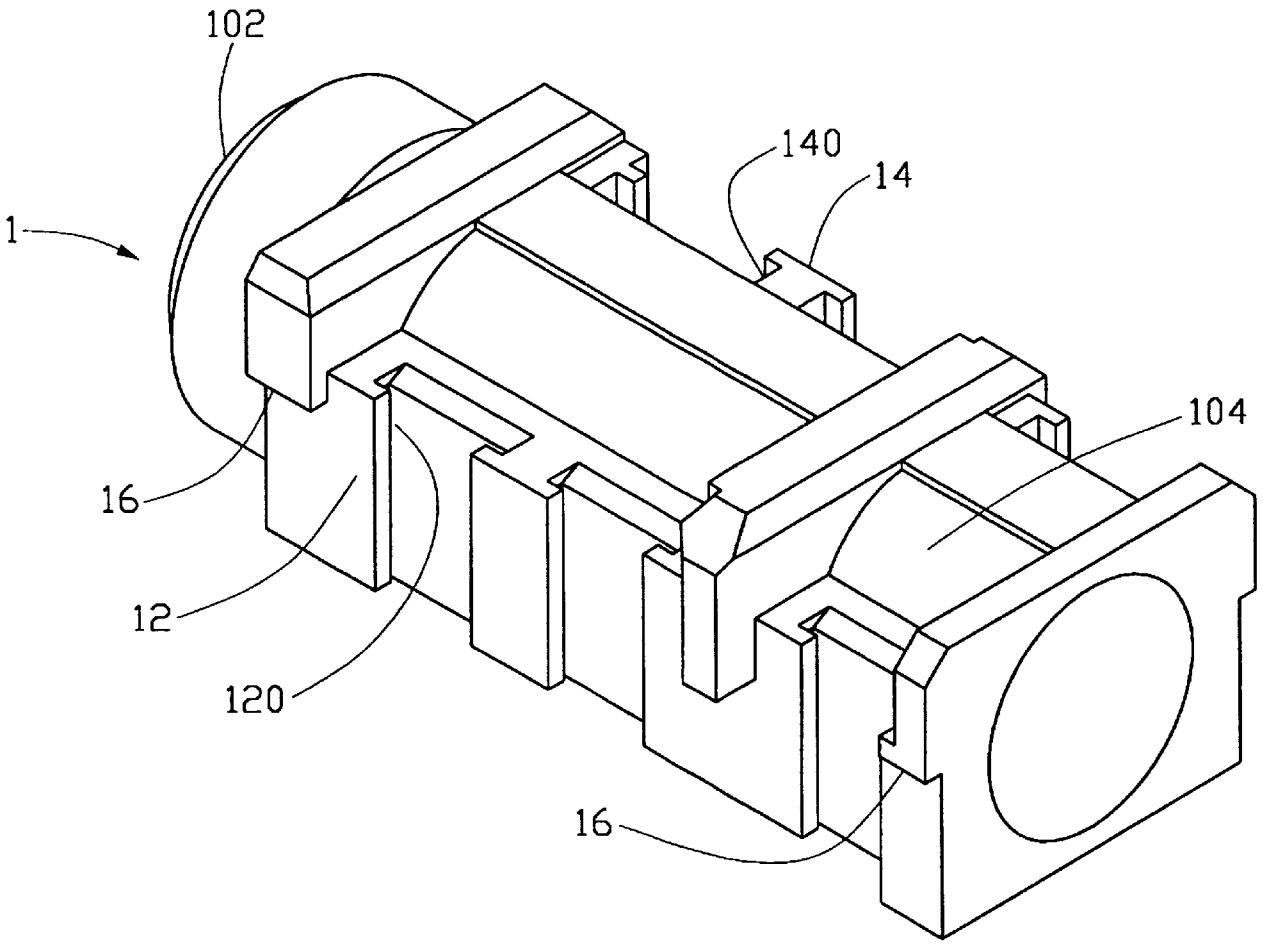
FIG. 2 is a perspective view of an insulative housing of the audio jack of FIG. 1.

Referring to FIGS. 1 and 2, an audio jack in accordance with the present invention comprises an elongate insulative housing 1, a plurality of fixing terminals 2 and a plurality of resilient terminals 3.

The elongate housing 1 defines a front opening 102 at a front end 10 thereof, a plug insertion hole 104 communicating with the front opening 102 and extending through a rear end (not labeled) of the housing 1 for allowing insertion of a contact of a plug connector (not shown), and a plurality of trapeziform receiving grooves 120, 140 recessed from both side faces 12 and 14 thereof. The housing 1 forms a pair of standoffs 16 at each end thereof which protrude from both of the side faces 12 and 14 for placing the housing 1 on a printed circuit board (not shown).

Figure 3:
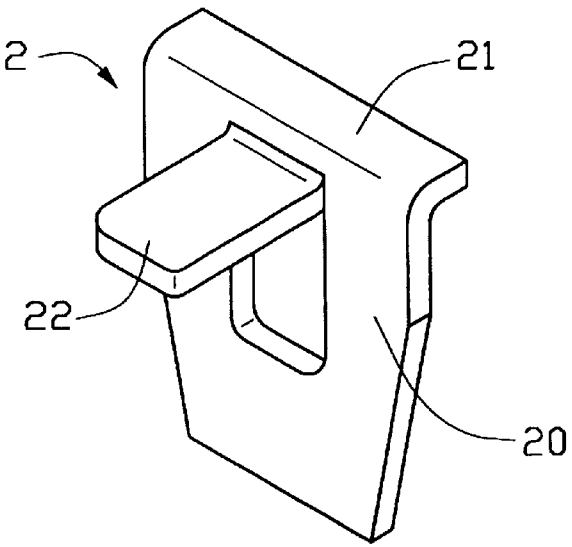
FIG. 3 is a perspective view of a fixing terminal of the audio jack of FIG. 1.

Referring to FIG. 3, each fixing terminal 2 comprises a main body 20, a contact section 21 extending from the main body 20 and substantially perpendicular to the main body 20, and a solder pad 22 punched from the main body 20 for being soldered to the printed circuit board. The solder pad 22 is located below the contact section 21 for preventing molten solder from wicking from the solder pad 22 to the contact section 21 thereby preventing an inadvertent soldered connection between the contact section 21 and the resilient terminal 3.

Figure 4:
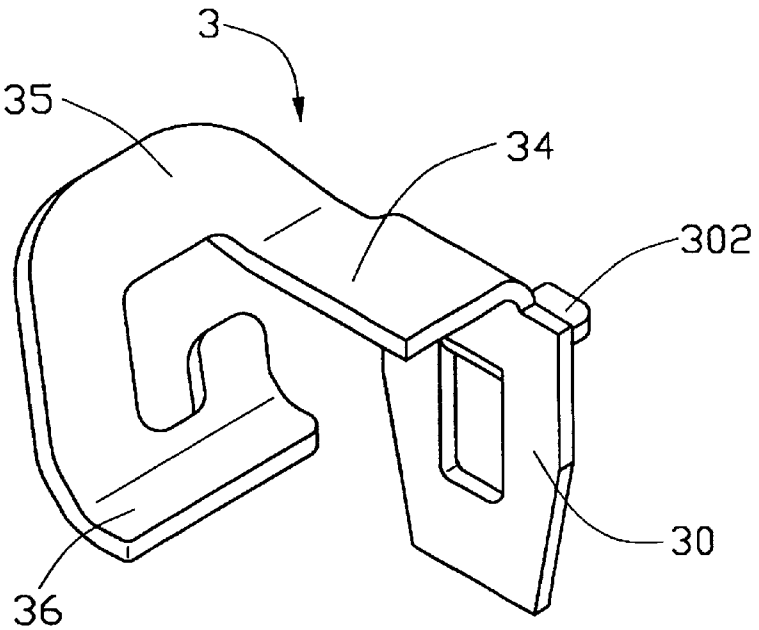
FIG. 4 is a perspective view of a resilient terminal of the audio jack of FIG. 1.

Referring to FIG. 4, the resilient terminal 3 comprises a main body 30 similar to the main body 20 of the fixing terminal 2, a connecting portion 34 perpendicularly extending from the main body 30, a resilient arm 35 slantwise extending from the connecting portion 34 round and away from the main body 30, and a contact portion 36 at a free end of the resilient arm 35 extending toward the main body 30 for contacting the fixing terminal 2. A solder pad 302 is punched from the main body 30 of the resilient terminal 3 for being soldered to the printed circuit board.

Figure 5:
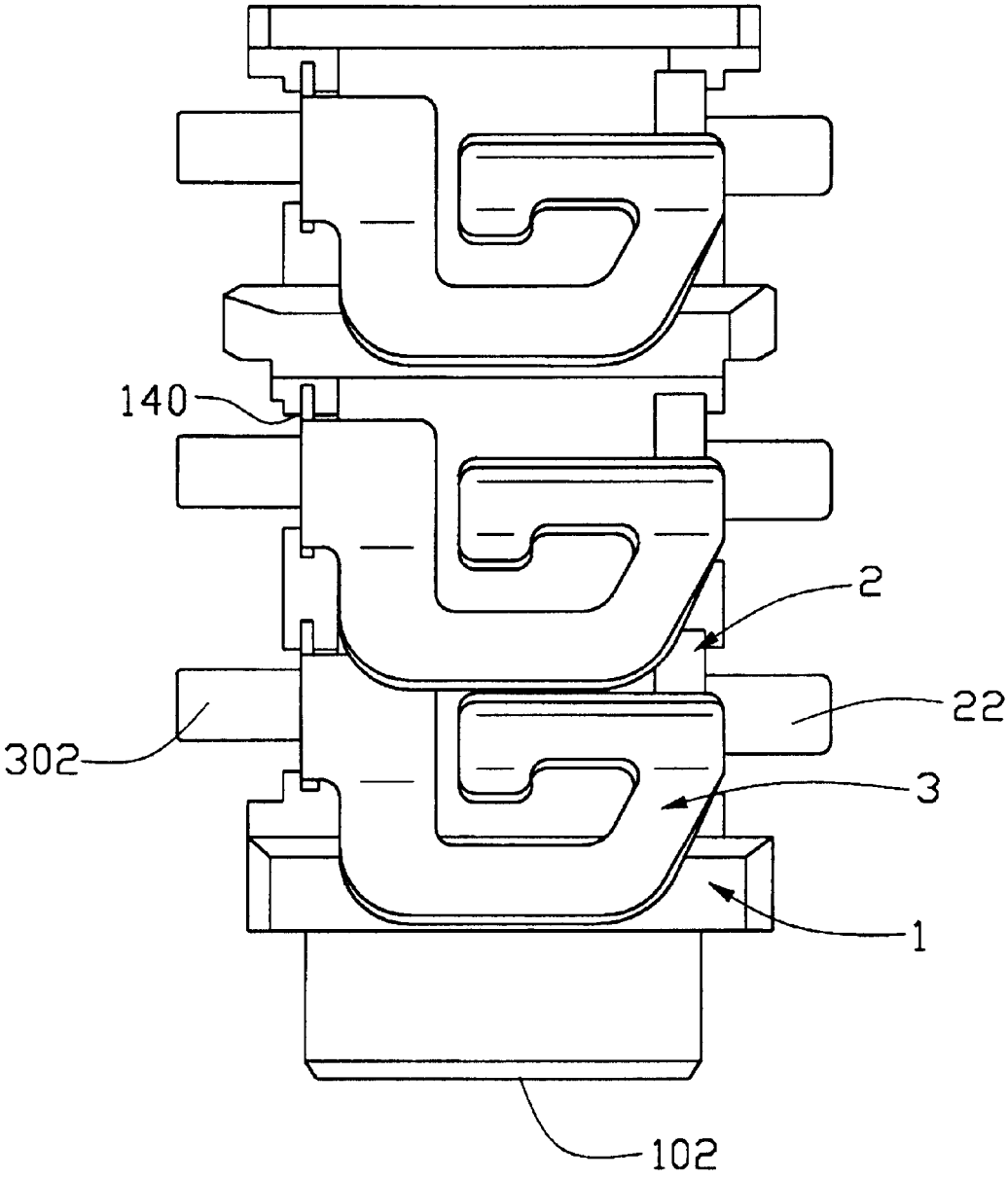
FIG. 5 is a top view of the audio jack of FIG. 1.
Figure 6:
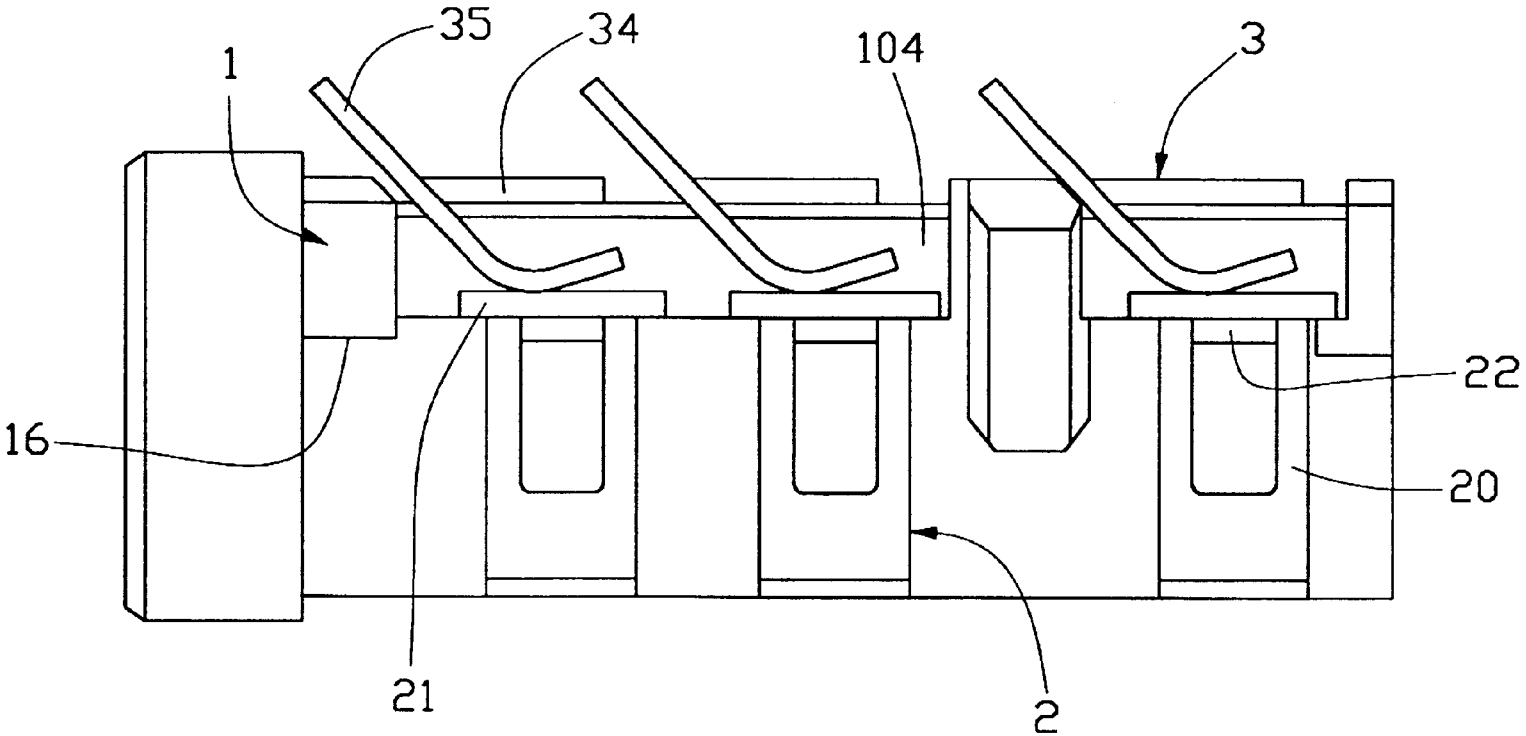
FIG. 6 is a side view of the audio jack of FIG. 1.
Figure 7:
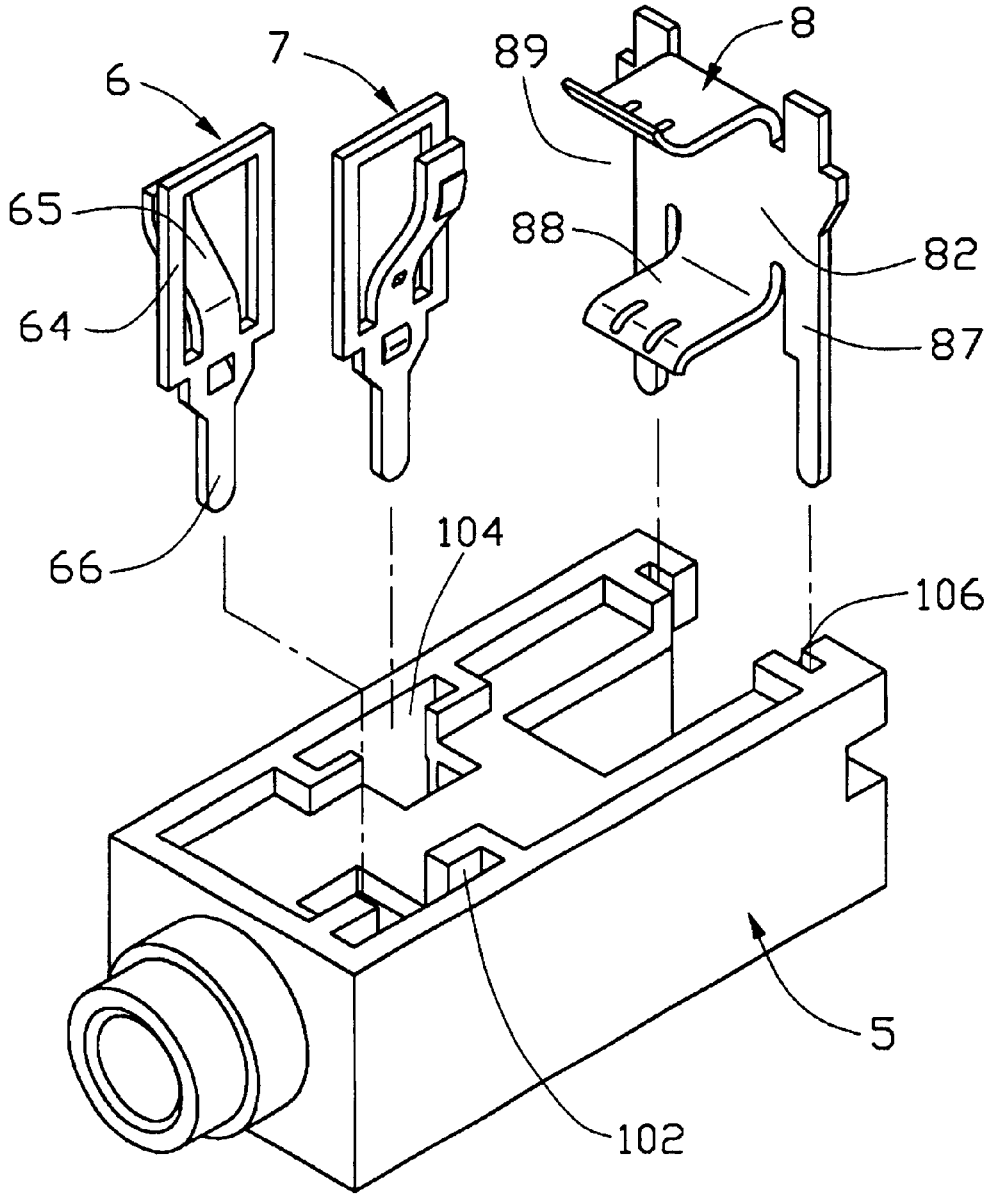
FIG. 7 (PRIOR ART)
FIG. 7 is an exploded view of a conventional audio jack.

Referring to FIGS. 1, 5 and 6, the main bodies 20 of the fixing terminals 2 and the main bodies 30 of the resilient terminals 3 are retained in corresponding receiving grooves 120 and 140 of the housing 1. The connecting portions 34 of the resilient terminals 3 are positioned on an upper surface (not labeled) of the housing 1. The contact portions 36 of the resilient terminals 3 abut against the contact sections 21 of the fixing terminals 2. Bottom faces (not labeled) of the solder pads 22 of the fixing terminals 2 and bottom faces (not labeled) of the solder pads 302 of the resilient terminals 3 are coplanar with bottom surfaces of the standoffs 16 of the housing 1.

When the plug connector is inserted into the plug insertion hole 104 of the audio jack from the front opening 102, the contact of the plug connector pushes the contact portions 36 of the resilient terminals 3 away from the contact sections 21 of the fixing terminals 2 thereby establishing signal transmission between the contact of the plug connector and those resilient terminals 3 which are within a distance from the front opening 102 less than a length of the audio jack. The resilient arm 35 of each resilient terminal 3 is resilient enough to restore the contact portion 36 to its original position when the plug connector is withdrawn.

One feature of the invention is to provide the terminal 3 with resilient arm 35 connecting to the connecting portion 34 wherein the resilient arm 35 with a contact portion 36 at the distal end, extends in a three dimensional manner with a G-like configuration so as to provide sufficient resilience thereof. Another feature of the invention is to have the contact section 21 and the solder pad 22 of the terminal 2 vertically offset from each other, so as to prevent the contact portion 36 from being mistakenly soldered to the contact section 21 due to wicking of soldering when the solder pad 22 is surface mounted to a corresponding printed circuit board.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An audio jack for mounting to a printed circuit board and mating with a contact of a plug connector, comprising:

an insulative housing defining a plug insertion hole for receiving said contact of the plug connector therein;

a fixing terminal disposed in one side of the housing, said fixing terminal including a contact section; and a resilient terminal disposed in the other side of the housing and aligned with said fixing terminal in a lateral direction of said housing, said resilient terminal including a connecting portion laterally opposite to the contact section of the fixing terminal and a resilient arm extending from said connecting portion; wherein said resilient arm cooperating with a contact portion at a free end thereof, commonly define a G-like configuration extending in a three dimensional manner, and said contact portion is positioned between the contact section of the fixing terminal and the connecting portion of the resilient terminal along said lateral direction of the housing; wherein a solder pad is punched from a main body of the resilient terminal for being soldered to the printed circuit board; wherein a solder pad is punched from the a body of the fixing terminal for being soldered to the printed circuit board; wherein the solder pad of the fixing terminal is located below the contact section of the fixing terminal for preventing molten solder from wicking from said solder pad of the fixing terminal to the contact section of the fixing terminal; wherein the housing forms on said both sides a plurality of standoffs which protrude from said both sides for placing the housing on the printed circuit board and wherein bottom faces of the solder pads of the resilient terminal and bottom faces of the solder pads of the fixing terminal are coplanar with bottom surfaces of the standoffs of the housing.

* * * * *